United States Patent [19]

Brown

[11] 4,269,133

[45] May 26, 1981

[54] HAND-HELD SAIL

[76] Inventor: Richard L. E. Brown, 382 Mowat Ave., Kingston, Ontario, Canada

[21] Appl. No.: 21,024

[22] Filed: Mar. 16, 1979

[51] Int. Cl.[3] ..... B63H 9/04

[52] U.S. Cl. ..... 114/103; 244/153 R; 280/810

[58] Field of Search ..... 114/103, 102, 39, 90; 244/DIG. 1, 16, 153 R; 267/164; 138/118; 280/810

[56] References Cited

U.S. PATENT DOCUMENTS

| | | | |
|---|---|---|---|
| 1,178,165 | 4/1916 | Lupton, Jr. | 280/11.37 S |
| 1,859,178 | 5/1932 | Sprinkle | 114/39 |
| 2,569,318 | 9/1951 | Kersten | 114/103 |
| 2,793,870 | 5/1957 | Bowman | 280/11.37 S |
| 3,250,500 | 5/1966 | Hall | 244/DIG. 1 |
| 3,313,314 | 4/1967 | Burke et al. | 138/118 X |
| 3,742,886 | 7/1973 | Dillon | 114/39 X |
| 3,768,823 | 10/1973 | Goldberg | 280/11.37 S |
| 3,828,711 | 8/1974 | Russell | 114/103 |
| 3,924,870 | 12/1975 | Spivack et al. | 280/11.37 S |
| 3,960,346 | 6/1976 | Cho | 244/153 R X |
| 4,015,802 | 4/1977 | Heredia | 244/153 R |
| 4,074,647 | 2/1978 | Delaney | 114/90 X |
| 4,133,500 | 1/1979 | Chapman | 244/DIG. 1 |

FOREIGN PATENT DOCUMENTS

| | | | |
|---|---|---|---|
| 2738374 | 1/1979 | Fed. Rep. of Germany | 114/90 |

*Primary Examiner*—Sherman D. Basinger
*Attorney, Agent, or Firm*—Ridout & Maybee

[57] ABSTRACT

In a skate sail assembly of the type having a T-configured frame including a boom and a resiliently flexible mast detachably mounted thereon, and a generally sector-shaped sail supported in a taut condition by the frame, the boom has a U-shaped resilient portion intermediate its ends, which portion imparts flexibility to the boom in the longitudinal direction and additionally serves as a handle for the user. The flexibility imparted by the U-shaped resilient portion of the boom and the mast enables the device to be more easily assembled and dismantled, and is essential in order that the sail may function satisfactorily as an airfoil.

9 Claims, 5 Drawing Figures

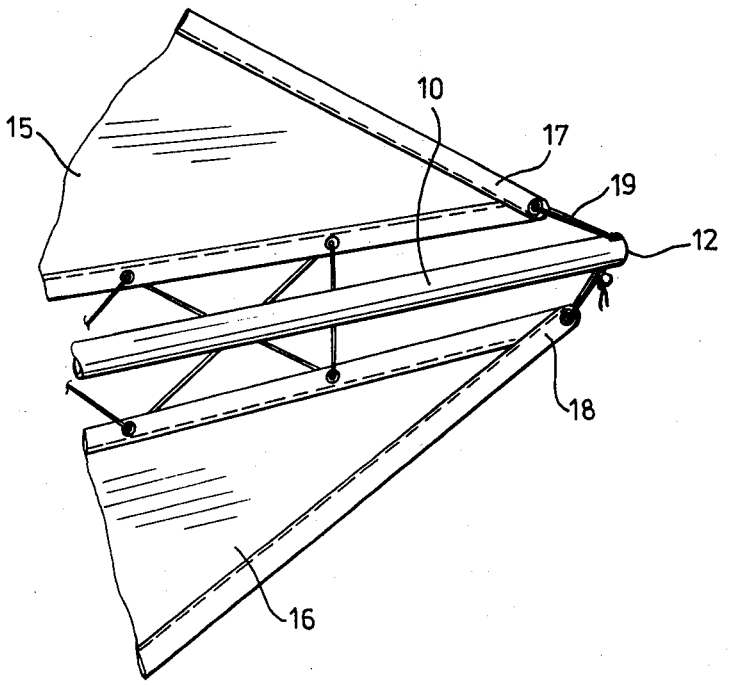
FIG. 3
FIG. 4
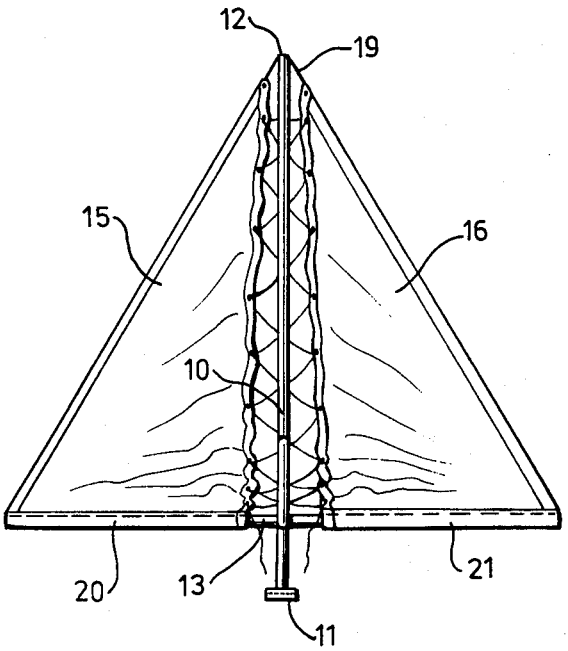
FIG. 5
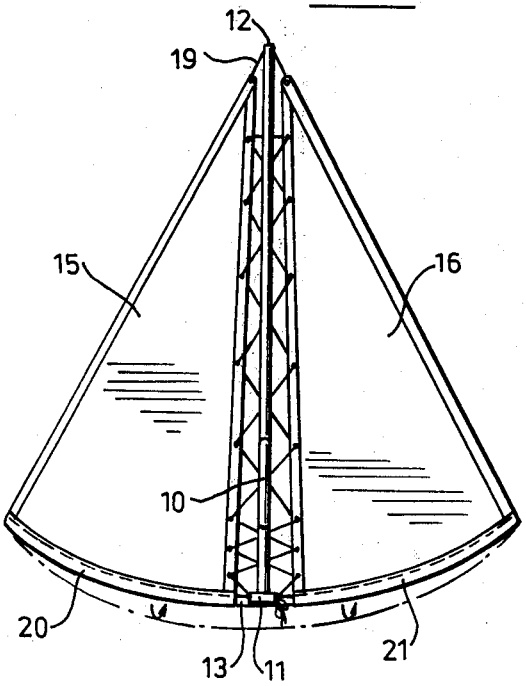

HAND-HELD SAIL

This invention relates to hand-held sails such as, for example, skate sails of the type intended to be used by ice skaters for propulsion of the skater by the wind.

It is known to provide a device of this type which can be readily assembled and disassembled, the device consisting essentially of a sail member adapted in use to define an airfoil configuration and a generally rigid frame structure to which the sail member is attached. The frame structure typically comprises a number of rodlike or tubular components which can be fitted together to form a longitudinally extending boom with a plurality of transverse masts mounted thereon, the sail member being formed with pockets for receiving the masts so as to support the sail member in its spread condition. Thus, U.S. Pat. No. 1,859,178, issued to S. A. Sprinkle on May 17, 1932, discloses such a device comprising a sail member of triangular configuration supported by a rigid frame structure consisting essentially of a rigid, longitudinally extending boom having a pair of rigid transverse masts which are received in pockets of the sail member, the boom and at least the larger one of the two masts being made up of rod sections which are fitted together by sockets for receiving the ends of the rod sections. U.S. Pat. No. 3,768,823, in the name D. E. Goldberg and dated Oct. 30, 1973, shows a different construction in which the sail member is of truncated sector shape and in which the frame structure comprises a rigid longitudinally extending boom with a rigid transverse mast and fore and aft bow-shaped masts received in pockets provided in the fore and aft edges of the sail member. The boom and at least the transverse and forward masts are each made up of sections to be fitted together end to end.

It is an object of the present invention to provide an improved sail assembly which, on the one hand, while being simpler in construction than the devices referred to above can be more easily assembled for use and disassembled for stowage, and which on the other hand affords a degree of longitudinal flexibility thereby enabling the sail member to function effectively as an airfoil in use.

This is achieved, basically, by providing a frame structure of T-shaped configuration consisting of a longitudinally extending boom having a resilient intermediate portion of U-shaped configuration, and a transverse resiliently flexible mast engageable at its midpoint with the front end of the boom. A generally sector-shaped sail adapted to define an airfoil configuration is attached to the mast by its leading edge and is attached to the rear end of the boom so as to be supported in a taut condition between the mast and the rear end. The U-shaped portion of the boom may conveniently form a handle to be held by the user.

Thus, a hand-held sail assembly in accordance with the invention comprises:

a generally sector-shaped sail adapted to define an airfoil configuration, a frame structure of generally T-shaped configuration for supporting the sail, the frame structure consisting of a longitudinally extending boom having front and rear ends, and a transverse resiliently flexible mast engageable at its midpoint with the front end of the boom to define therewith said T-shaped configuration, the sail having an apex portion engageable with the rear end of the boom and a transverse leading edge providing attachment means by which it is attachable to the mast for supporting the sail in a taut condition between said rear end of the boom and the mast, the boom further providing a resilient portion of U-shaped configuration at a position intermediate its ends, said portion imparting a degree of flexibility in the longitudinal direction, said U-shaped portion extending in a direction transverse to the plane of said T-shaped configuration thereby to serve as a handle for gripping the assembly.

The sail preferably comprises a symmetrical pair of sector-shaped sail portions each having a rearwardly directed apex portion and a transverse leading edge, the apex portions being interconnected by a first attachment means, such as a lanyard, engageable with the rear end of the boom, and the leading edges each providing a pocket constituting second attachment means by which the leading edges of the sail portions are attached to the mast on either side of the front end of the boom. With this construction the inner edges of the sail portions can be spaced apart to define a viewing opening to enable the skater to see through to the other side of the sail.

One embodiment of the invention, as applied to a sail intended to be used by skaters, will now be described, by way of example, with reference to the accompanying drawings, in which:

FIG. 3 shows a detail of the attachment of the sail to the rear end of the boom; and FIGS. 4 and 5 illustrate stages in the assembling of the device.

Figure 1:
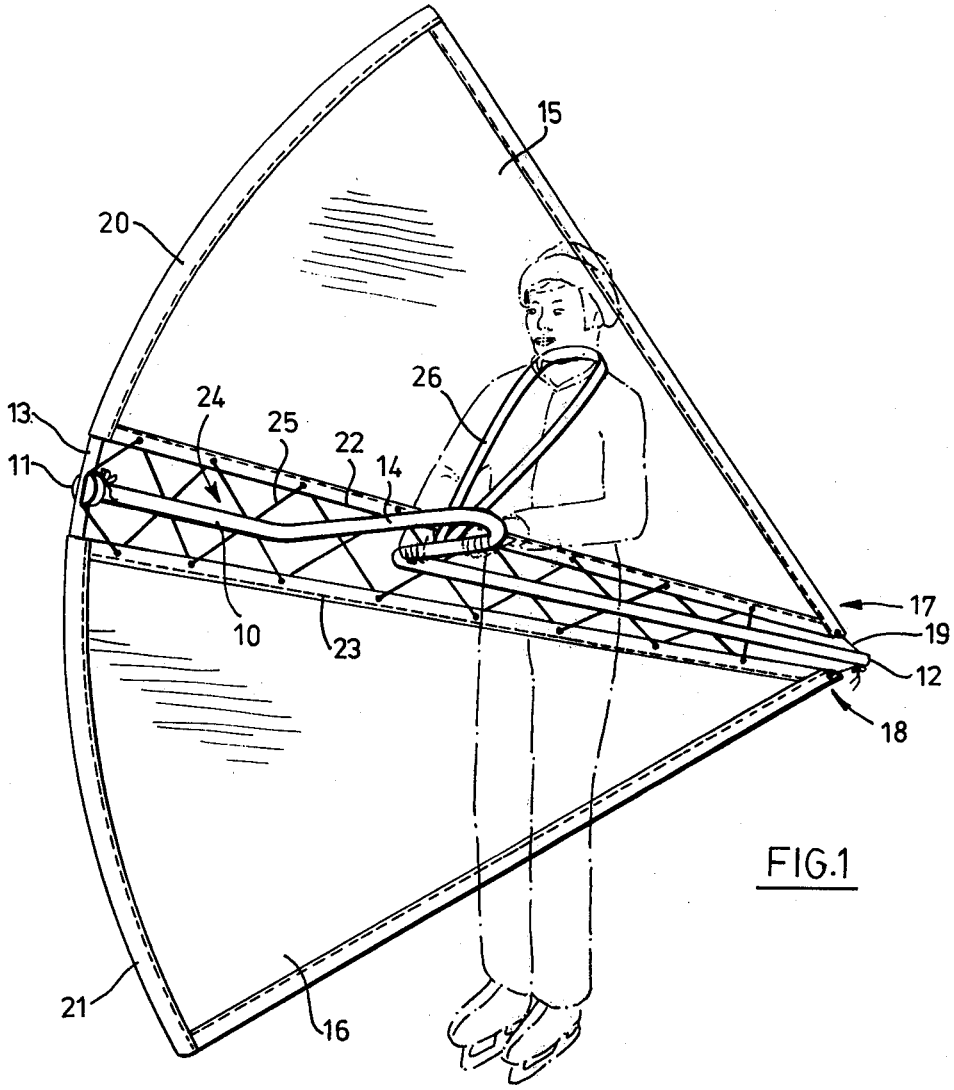
FIG. 1 is a perspective view of a skate sail assembly in accordance with the invention, the device being assembled ready for use.
Figure 2:
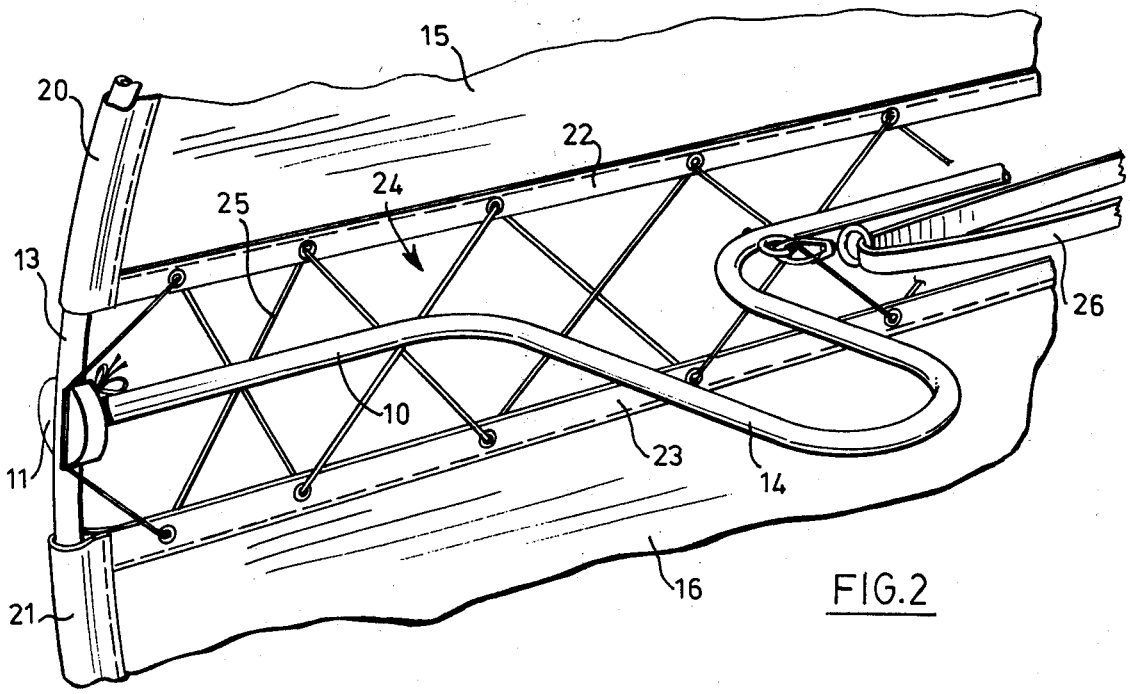
FIG. 2 is an enlarged view showing details of the boom and sail portions.

The skate sail assembly basically comprises a sail supported by a frame structure. As shown in the drawings, the frame structure is of T-shaped configuration consisting of a longitudinally extending boom 10 having a front end 11 and a rear end 12, and a transverse resiliently flexible mast 13 which engages the front end 11 of the boom at its midpoint thereby defining the T-shaped configuration. The frame structure is of lightweight construction, the boom preferably being an aluminum thin-walled tube bent to the required shape and the mast being a glass-fibre reinforced, polyester, pultruded rod. The front end 11 of the boom is defined by a circular boss having a notch or slot in which the mast is received, the mast thereby being fixedly oriented with respect to the boom. As shown in FIG. 1, the mast is oriented so as to extend vertically when the device is used, although it will be appreciated that the device may also be used with the sail raised overhead in a horizontal attitude. The rear end 12 of the boom is also formed with a notch or slot to locate an attachment means for the sail as hereinafter described.

An important feature of the construction is that the boom 10 has a resilient portion 14 of U-shaped configuration at a position intermediate its ends. The primary purpose of this U-shaped portion is to impart a degree of flexibility to the boom in the longitudinal direction, that is, to make the boom more resilient in the longitudinal direction than would otherwise be the case. This affords two important advantages: it assists assembly of the device in the manner described hereinafter, and it affords the requisite flexibility for the mast-supported sail to function effectively as an airfoil. A secondary, but nevertheless important, purpose of the U-shaped portion 14 is to serve as a handle by which the user may hold the device, as shown in FIG. 1. For this purpose the U-shaped portion extends in a direction transverse to the plane of the T-shaped frame structure, that is, horizontally and perpendicular to the sail.

The sail is of sector-shaped configuration consisting of a symmetrical pair of sector-shaped sail portions 15, 16. Each of the sail portions 15 and 16 has an arcuate leading edge by which it is attached to the mast 13, and a rearwardly directed apex portion defining the rear end 17 or 18 of the sail. The rear ends of the sail portions are interconnected by a lanyard 19 forming a first attachment means by which the sail portions are attached to the rear end of the boom. The lanyard 19 engages in the notch or slot formed in said rear end of the boom. The leading edges of the sail portions 15, 16 are folded to form sleeves or pockets 20, 21 which receive respective portions of the mast 13 and constitute second attachment means by which the sail portions are detachably secured to the mast on either side of the front end 11 of the boom. The sail portions are thus held in a taut condition between the mast and the rear end of the boom. The sail portions 15, 16 have respective inner edges 22, 23 which are spaced apart in the assembled device, as shown in FIG. 1, thus defining a viewing opening 24 through which the user can look. The inner edges are, for convenience, laced together across the viewing opening by lacing 25. The device also includes a harness, for the user. This harness is formed by a strap 26 which is attached at its ends to the U-shaped portion 14 to form a loop which can be passed round the neck of the user.

The assembly is thus made up of four components, the sail, the boom, the mast, and the harness, the sail itself being made up of the two sail portions which are interconnected by the lanyard 19 and the lacing 25. The composite sail, which is of sector-shaped configuration in use, can readily be folded into a compact configuration for stowage. The mast 13, it should be mentioned, is in the form of a straight rod, as shown in FIG. 4, prior to assembly but is flexed into the bowed configuration when the device is assembled. In order to assemble the skate sail the sail portions are unfolded to the open condition and the mast 13 is inserted through the pockets 20, 21 at the leading edges of the sail portions as shown in FIG. 4. The boom 10 is next placed at right angles to the mast with the notched rear end 12 engaging the lanyard 19, and with the U-shaped handle portion extending away from the sail, and is moved rearwardly while the mast is being held so as to tauten the sail portions 15, 16. The sail portions thus take up their sector-shaped configuration, as shown in FIG. 5, the mast 13 assuming a bowed shape. The notched front end of the boom can then be brought behind the midpoint of the mast so that the mast can be received into the notch and located thereby. The device is thus completely assembled and ready for use, save for the lacing between the sails and the attachment of the harness in any convenient manner.

What I claim is:

1. A hand-held sail assembly comprising:

a generally sector-shaped sail adapted to define an airfoil configuration, a frame structure of generally T-shaped configuration for supporting the sail, the frame structure consisting of a longitudinally extending boom having front and rear ends, and a transverse resiliently flexible mast engageable at its midpoint with the front end of the boom to define therewith said T-shaped configuration, the sail having an apex portion engageable with the rear end of the boom and a transverse leading edge providing attachment means by which it is attachable to the mast for supporting the sail in a taut condition between said rear end of the boom and the mast, the boom further comprising end portions joined by a resilient portion of U-shaped configuration, said portion imparting flexibility to the boom in the longitudinal direction, the bight of said U-shaped portion extending in a direction transverse to the plane of said T-shaped configuration thereby to serve as a handle for gripping the assembly.

2. A hand-held sail assembly according to claim 1, wherein the boom is notched at its ends, the mast being detachably engageable in the notch at said front end and the apex portion of the sail providing attachment means engageable in the notch at said rear end.

3. A hand-held sail assembly according to claim 1, wherein the sail is formed with pockets at its leading edge adapted to receive the mast and constituting said attachment means.

4. A hand-held sail assembly according to claim 3, wherein the sail comprises a symmetrical pair of sail portions having opposed inner edges defining a viewing opening therebetween.

5. A hand-held sail assembly comprising:

a generally sector-shaped sail adapted to define an airfoil configuration, a frame structure of generally T-shaped configuration for supporting the sail, the frame structure consisting of a longitudinally extending boom having front and rear ends, and a transverse resiliently flexible mast engageable at its midpoint with the front end of the boom to define therewith said T-shaped configuration, the sail consisting of a symmetrical pair of separate sector-shaped sail portions each having a rearwardly directed apex portion and a transverse leading edge, said apex portions being interconnected by a first attachment means engageable with the rear end of the boom, said leading edges each providing a mast-receiving pocket constituting second attachment means by which said leading edges are attachable to the mast on either side of the front end of the boom, for supporting the sail portions in a taut condition between said rear end of the boom and the mast, the boom further comprising end portions joined by a resilient portion of U-shaped configuration, said U-shaped portion imparting a degree of flexibility to the boom in the longitudinal direction, the bight of said U-shaped portion extending in a direction transverse to the plane of said T-shaped configuration thereby serving as a handle for gripping the assembly.

6. A hand-held sail assembly according to claim 5, said sail portions having respective spaced-apart inner edges defining a viewing opening therebetween.

7. A hand-held sail assembly according to claim 6, wherein said inner edges of the sail portions are laced together across the viewing opening.

8. A hand-held sail assembly according to claim 7, wherein the boom is notched at its front and rear ends, the mast being detachably engageable in the notch at said front end and said first attachment means being detachably engageable in the notch at said rear end.

9. A hand-held sail assembly according to claim 8, including a harness formed by a strap attached at its ends to said U-shaped portion of the boom and forming a loop adapted to be passed round the shoulder of the user.

* * * * *